US005228782A

United States Patent [19]

Imer

[11] Patent Number: 5,228,782

[45] Date of Patent: Jul. 20, 1993

[54] RESEALABLE FLEXIBLE PACKS

[76] Inventor: Rodney H. Imer, Berliner Allee 45, D-4000, Düsseldorf 1, Fed. Rep. of Germany

[21] Appl. No.: 812,601

[22] Filed: Dec. 23, 1991

[30] Foreign Application Priority Data

Dec. 24, 1990 [DE] Fed. Rep. of Germany ... 9017419[U]

[51] Int. Cl.[5] ..... B65D 33/16; B65D 33/36

[52] U.S. Cl. ..... 383/200; 383/88; 383/906

[58] Field of Search ..... 383/70, 71, 77, 88, 383/89, 200, 906

[56] References Cited

U.S. PATENT DOCUMENTS

| | | | |
|---|---|---|---|
| 432,308 | 7/1890 | Guilbert | 383/88 |
| 514,889 | 2/1894 | Guilbert | 383/88 |
| 2,325,921 | 8/1943 | Salfisberg | 383/88 X |
| 2,333,587 | 11/1943 | Salfisberg | 383/88 X |
| 2,538,585 | 1/1951 | Oden | 383/88 |
| 3,217,934 | 11/1965 | Schneider et al. | 383/89 X |
| 3,224,640 | 12/1965 | Schneider et al. | 383/88 X |
| 3,642,189 | 2/1972 | Widenback | 383/906 X |
| 3,679,126 | 7/1972 | Lake | 383/77 |
| 3,815,810 | 6/1974 | Wellman | 383/89 X |
| 4,171,755 | 10/1979 | Carlisle | 383/906 X |

FOREIGN PATENT DOCUMENTS

| | | | |
|---|---|---|---|
| 0281529 | 1/1915 | Fed. Rep. of Germany | 383/88 |
| 1016042 | 10/1952 | France | 383/89 |
| 1088414 | 10/1967 | United Kingdom | 383/70 |

*Primary Examiner*—Stephen P. Garbe
*Assistant Examiner*—Jes F. Pascua
*Attorney, Agent, or Firm*—Sprung, Horn, Kramer & Woods

[57] ABSTRACT

A resealable sachet that is designed to contain substances of liquid or creamy consistency and which after opening and partial use of the contents, may be easily resealed and which thereby prevents the leakage of the remaining contents and which can be easily and economically manufactured. The sachet consists of two essentially parallel arranged layers made of flexible film-like material with given outer contours which are connected tightly at least at their edges and which form an enclosed volume to be filled with the substance. A part of the enclosed volume is formed as a narrow outlet channel within an opening strap leading to the edge of the sachet and is sealed by a tear-off section. At least one sealed side of the sachet adjacent to the outlet channel strap has a holding slit whose length is adjusted to the width of the outlet channel strap. The position of the holding slit is arranges so that the folded opening strap can be pulled through the holding slit with at least one part of its length to reseal the sachet.

9 Claims, 3 Drawing Sheets

RESEALABLE FLEXIBLE PACKS

BACKGROUND OF THE INVENTION

This invention relates to flexible packs and sachets that are designed to contain substances of liquid and creamy consistency, and which are resealable. Throughout this specification the term "sachet" will be used to define such flexible packaging types manufactured from thin films or papers or other flexible materials.

The invention relates to a sachet, in particular a sachet to contain liquid or creamy substances. The sachet consists of two essentially parallel arranged layers made of flexible material with given outer contours which are connected tightly that is, liquid tight, at least at their edges and which form an enclosed volume to be filled with a liquid or creamy substance. A part of the enclosed volume is formed as an outlet channel leading to the edge of the sachet and which is sealed at its end by a tear-off strip or section. Sachets are generally used to keep and carry smaller amounts of liquid or creamy food or cosmetic or household products. It is common practice to furnish such sachets with a tear-off section so that the sachet is opened by tearing off the section. The contents can then be squeezed or poured out. The German Utility Model G 81 27 806.3 and the German Patent Specification No. 31 43 671 for example, describe such sachets.

A disadvantage of such sachets is that they cannot be resealed after initial opening, which complicates the storage, the carrying and repeated or later use of the contents. Often the sachet is thrown away before it has been completely emptied, which leads to a waste of the unused contents.

The consumer would naturally be interested in keeping the unused content of the opened sachet for later use, however, leaking of the contents would cause undesirable damage to clothing or handbag, etc.

Several attempts to create a sachet which can be resealed easily so that the unused contents can be kept for later use without leaking, and which avoids a waste of the contents as well as avoids damage due to undesirable leaking of the contents, and thus resolving conventional problems, have failed.

The French Patent Specification No 1 016 042 describes a tube-like sachet made out of thermoplastic material to contain liquid or creamy substances. This sachet has a narrow section at one end, furnished with an outlet, which is folded back and can be put under a strap which is connected with the edges of the sachet. This sachet has the disadvantage that the seal is only then leakproof when there is sufficient inner pressure to press the folded section to the strap. This means that liquids can easily leak out when the sachet is only partially full due to the folded section not being held tight in its folded position by the strap, which can only maintain tension when the sachet is full. A further disadvantage is in the high production cost which this sachet design involves.

Moreover, in a sachet described in the European Patent Application with the publication No. 0 370 957 there is a plastic sachet with a sachet neck containing an aluminum detail. To seal the sachet the neck is folded back at the aluminum detail which is designed to fix the sachet neck in the closed position. This sachet also involves high production costs due to the necessary aluminum detail, and does not guarantee an absolutely leakproof sealing of the sachet.

SUMMARY OF THE INVENTION

It is the object of this invention to achieve a sachet that is easily resealable and which does not leak after opening and resealing, and which can be produced easily and at reasonable cost.

According to the invention, the object is achieved by arranging at least one section of the outlet channel in a strap-like fashion within the contours of the sachet, with such outlet channel having a tear-off section at its outer end. At least one sealed side of the sachet adjacent to the outlet channel strap has a holding slit whose length is adjusted to the width of the outlet channel strap and whose position on the sachet is arranged so that the outlet channel strap can be folded over and its outer end can be inserted into the slit and pulled through the slit at least for a part of the length of the outlet channel.

Further embodiments of the inventions are described in following text.

According to the further embodiments herein described, the object of the invention is to create a method which enables sachets contained liquid or creamy substances to be resealed after initial opening, through the provision of a foldable strap-like outlet channel within the contours of the sachet, which when after opening and usage of part of the contents, is folded back against the sachet and whose open end is inserted through a holding slit in the sealed side of the sachet, and which is then pulled through the slit for part of its length and then pressed along the fold line creating a mechanical closure seal which is held in position by the holding slot and which stops the leakage of the remaining contents.

Apart form the opening and resealing features of the invention, such sachets may be of any shape and size and may serve as containers for liquid and creamy substances as such sachets are normally used.

Further embodiments of sachets according to the invention are explained in the enclosed drawings.

The drawings show:

DETAILED DESCRIPTION OF THE INVENTION

To begin with, a first version of a sachet as well as its opening and resealing are explained in more detail by help of FIG. 1 to 3 and 7.

Figure 1:
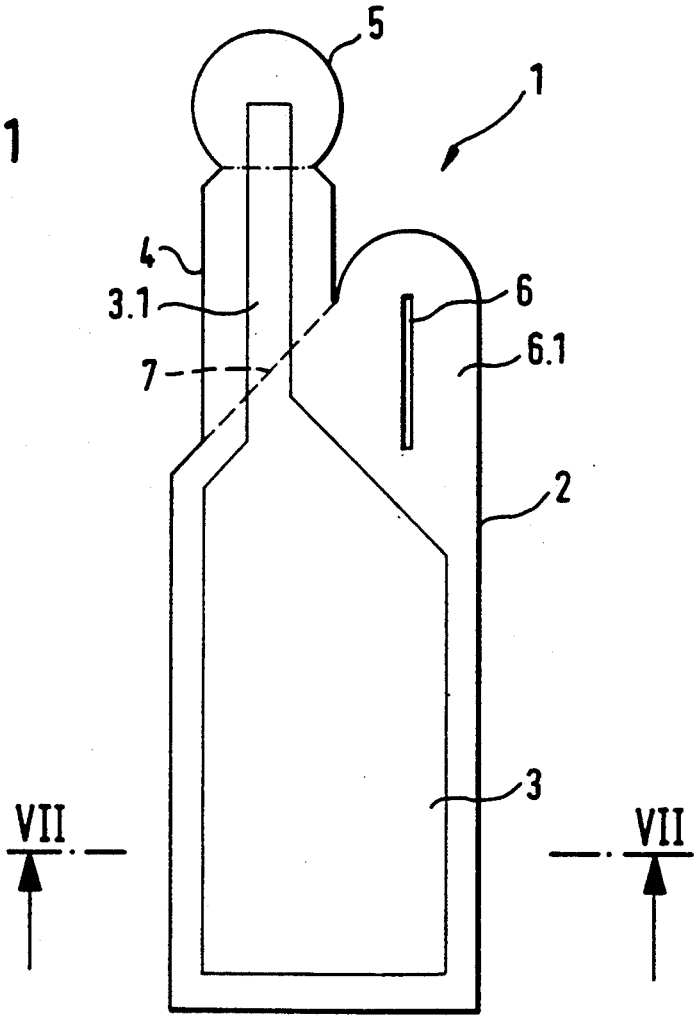
FIG. 1 is front view of a first embodiment of a resealable sachet according to the invention before opening.
Figure 7:
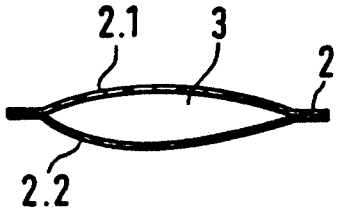
FIG. 7 is a cross sectional view of the resealable sachet of FIG. 1 along line VII—VII.

The sachet which in FIG. 1 to is referred to with reference number 1, has as shown in FIG. 7, a body 2 which is composed of two mainly parallel arranged sections 2.1 and 2.2, consisting of flexible film-like material, e.g. a plastic film or a metal-covered plastic film, which are liquid tightly connected with one another at their edges. The sections 2.1 and 2.2 embrace the inner section 3 of the sachet which contains a liquid or creamy substance. Body 2 is connected with an opening strap 4 which at one end has a tear-off section 5. The opening strap bears an outlet channel 3.1, which through its openable end 8 enables a squeezing out of the contents from the inner section 3, after tearing off the tear-off section 51. Furthermore, body 2 has at its edges a part section 6.1 in which the two sections 2.1 and 2.2 are tightly and firmly connected with one another, and a holding slit 6 whose length is adjusted to the breadth of opening strap 4 and which in this embodiment runs parallel to the direction of the opening strap 4.

Figure 2:
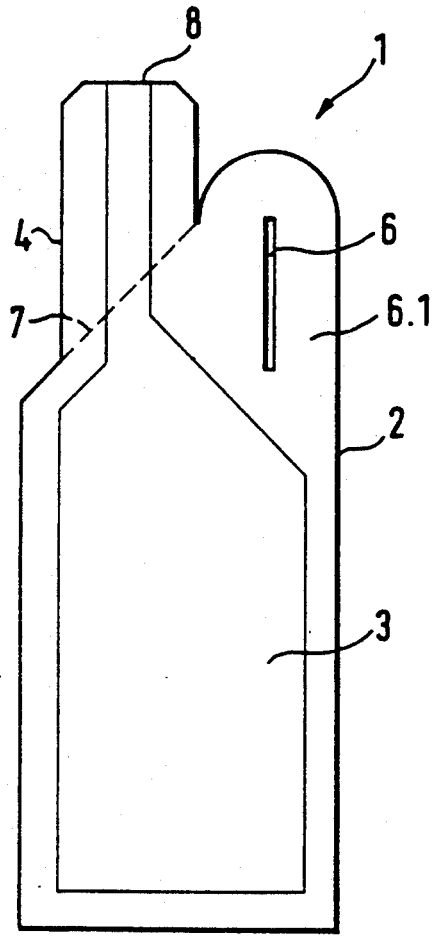
FIG. 2 is a front view of the sachet of FIG. 1 after removal of the tear-off section of the opening strap.

FIG. 2 shows the sachet according to FIG. 1, after tearing off the tear-off section 5, i.e. a position in which its contents can be squeezed out.

Figure 3:
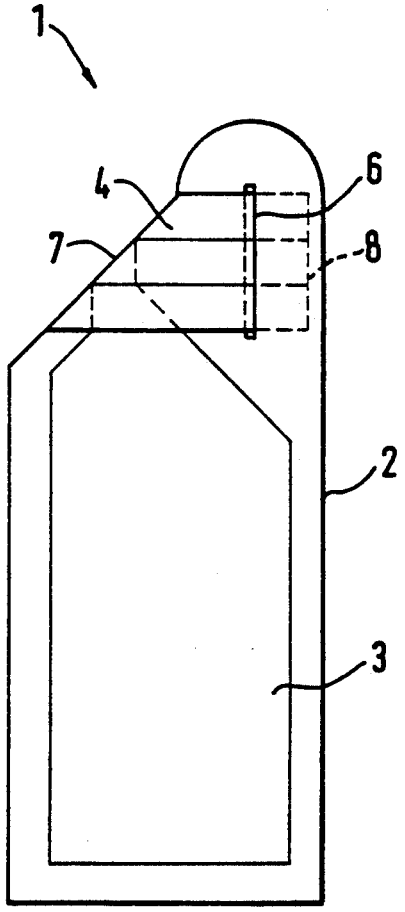
FIG. 3 is a front view of the sachet of FIG. 1 in a resealed condition.

As shown in FIG. 3, the sachet is resealed by folding back the opening strap along the folding line 7 which is arranged at the attachment point of the opening strap 4 to section 2 of the sachet at an angle of 45° to the longitudinal direction of the opening strap 4 on section 2, and by pulling the open end 8 of the opening strap 4 through the holding slit 6 and then firmly pressing the fold 7 of the opening strap 4.

The mechanical effect of squeezing the fold in the opening strap 4 along the folding line 7 is sufficient to prevent a leakage of the contents from inner section 3 under normal usage conditions.

To reopen the sachet according to FIGS. 1 to 3, the opening strap 4 is pulled out of the holding slit 6 and is brought back to its original position as shown in FIG. 2. Pressure on the outer surface of section 2.1 and 2.2 which delineate the inner section 3 causes a part of or all of the liquid or creamy substance in inner section 3 to be squeezed out of the sachet through the outlet channel 3.1 and the open end 8 of the opening strap 4. The resealing and reopening procedure as described above can be repeated until, the sachet has been completely emptied.

Figure 4:
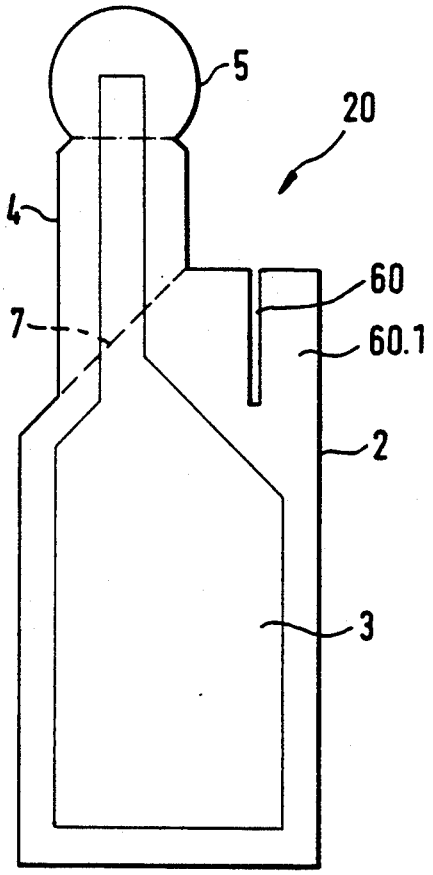
FIG. 4 is a front view of a second embodiment of the resealable sachet.
Figure 5:
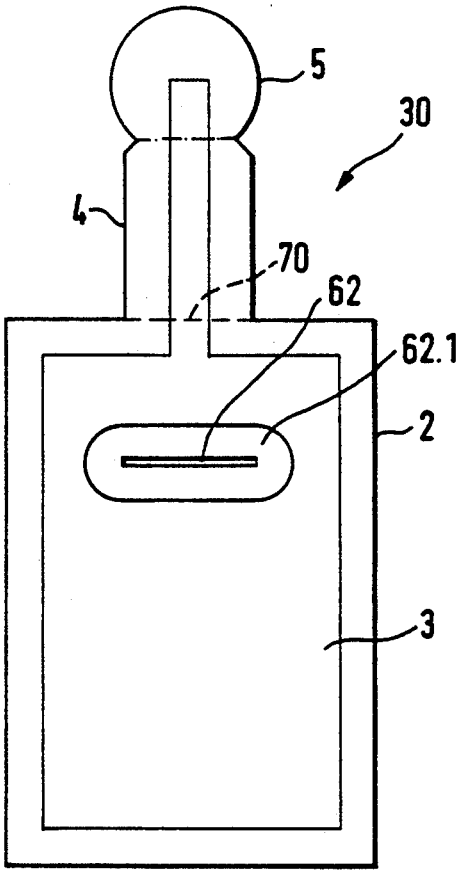
FIG. 5 is a front view of a third embodiment of the resealable sachet.
Figure 6:
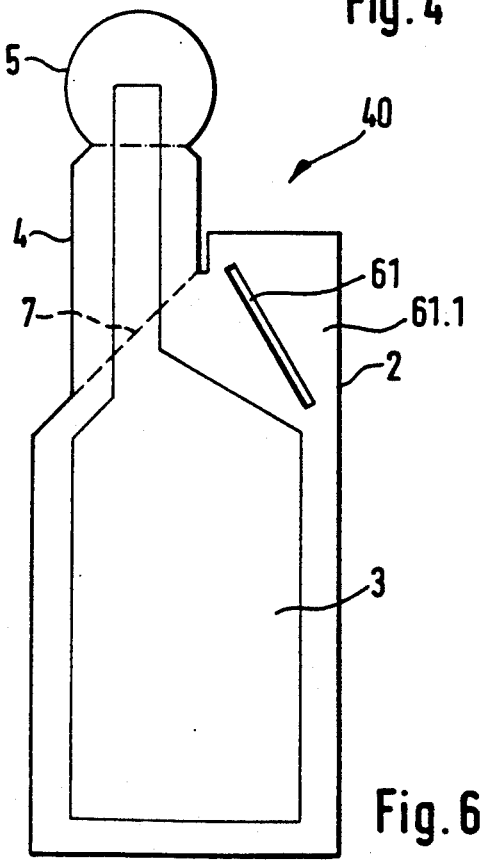
FIG. 6 is a front view of a fourth embodiment of the resealable sachet.

Further embodiments of the resealable sachet are described in FIGS. 4 to 6. Parts exactly corresponding to the version according to FIGS. 1 to 3 are referred to by the same number.

The sachet bearing reference number 20 as shown in FIG. 4, differs form the version according to FIG. 1 to 3 in that here the holding slit 60, also running parallel to the opening strap 4 is in a section 60.1 at the edge of body 2 of the sachet and is open at one end, which facilitates inserting the opening strap 4 which is folded along the folding line 7 and inserted into holding slit 60.

The version shown in FIG. 5 bears the reference number 30 and the holding slit 62 runs vertical to the opening strap 4 and is not arranged at the edge of body but away from the edge towards the middle in a section 62.1 in which the sections, made of flexible material of which body 2 of the sachet is formed, are closely connected to one another. Also with this embodiment, the sachet is opened by tearing off the tear-off section 5 and is resealed by folding the opening strap 4 along the folding line 70, which in this case runs vertical to the longitudinal direction of opening strap 4, and by inserting opening strap 4 into the holding slit 62 and by pulling of opening strap 4 through this slit until a sufficient mechanical squeezing of the fold along fold line 70 is reached and the leakage of the contents is prevented. This version also enables repeated opening and resealing.

The version according to FIG. 6, in which the sachet bears the reference number 40 is similar to the version according to FIG. 1 to 3 except the at holding slit 61 is arranged at a section 61.1 in the edge of body 2 at an acute angle to the longitudinal direction of opening strap 4.

Along with this embodiment, the sachet is opened and resealed analogous to the version described above.

Naturally, other embodiments of the described resealable sachet are possible. Decisive is however, that the opening strap and the holding slit are arranged in a way that after tearing off the tear-off section of the opening strap, the opening strap can be inserted into the holding slit and can be pulled through, so that a fold along the fold line is formed, which prevents a leaking of the contents when pressed mechanically.

What is claimed is:

1. A sachet comprising:

two superposed layers of flexible film-like material;

means sealing the two layers together to define a container section including a chamber for containing liquid and creamy substances, an outlet section adjacent the container section and including an outlet channel having one end in communication with the chamber and having an outer end leading to an edge, wherein the outlet channel extends in one direction outwardly of the chamber and the outlet section has side edges extending parallel to each other along the one direction, and a sealing section adjacent the edge of the outlet channel for sealing the outer end of the outlet channel;

means for enabling the sealing section to be torn off from the outlet section at the edge to open the outlet channel and thereby the chamber to outside of the sachet;

means forming a folding line in the outlet section at an angle of 45° to the one direction and about which said outlet channel is foldable relative to the container section; and means forming a holding slit in the two layers and sealed from the chamber and the outlet channel, wherein the holding slit is configured to slidably receive the outlet section with the parallel side edges and the holding slit is positioned to receive the outer end of the outlet section when the sealing section is torn off and the outlet section is folded along the folding line.

2. The sachet according to claim 1, wherein the means forming the holding slit comprises a holding section at an edge of the two layers wherein the two layers are sealed together and surrounding the holding slit.

3. The sachet according to claim 2, wherein the holding slit extends parallel to the one direction.

4. The sachet according to claim 2, wherein the holding slit is positioned at an acute angle to the one direction.

5. The sachet according to claim 1, wherein the means forming the holding slit comprises a section at an edge of the two layers wherein the two layers are sealed together and wherein the holding slit extends to the edge and is open thereat.

6. The sachet according to claim 2, wherein the holding slit is enclosed by the holding section.

7. The sachet according to claim 1, wherein the means forming the holding slit comprises a section within the container section wherein the two layers are sealed together.

8. The sachet according to claim 1, wherein the folding line is along a connection between the outlet section and the container section.

9. The sachet according to claim 1, wherein the outlet channel is substantially smaller in width than the chamber.

* * * * *